US005524316A

United States Patent [19]

Johnson

[11] Patent Number: 5,524,316

[45] Date of Patent: Jun. 11, 1996

[54] HAND TOOL FOR DECORATIVELY APPLYING PLASTER

[75] Inventor: Max Johnson, Mount Washington, Ky.

[73] Assignee: D & I Insulation & Drywall, Inc., Mt. Washington, Ky.

[21] Appl. No.: 274,226

[22] Filed: Jul. 13, 1994

[51] Int. Cl.[6] ..... A47K 1/02

[52] U.S. Cl. ..... 15/210.5; 15/236.08; 15/245.1

[58] Field of Search ..... 15/210.5, 245.1, 15/236.08

[56] References Cited

U.S. PATENT DOCUMENTS

| | | | |
|---|---|---|---|
| 919,439 | 4/1909 | Lawrence | 15/210.5 |
| 3,059,261 | 10/1962 | Carruth et al. | 15/210.5 |
| 3,843,992 | 10/1974 | Briggs | 15/210.5 |

FOREIGN PATENT DOCUMENTS

| | | | |
|---|---|---|---|
| 197512 | 5/1958 | Austria | 15/245.1 |
| 996342 | 12/1951 | France | 15/210.5 |
| 734013 | 4/1943 | Germany | 15/236.08 |
| 460080 | 10/1950 | Italy | 15/210.5 |
| 170529 | 3/1960 | Sweden | 15/245.1 |
| 376645 | 5/1964 | Sweden | 15/236.08 |

*Primary Examiner*—Chris K. Moore

*Attorney, Agent, or Firm*—Middleton & Reutlinger; James C. Eaves, Jr.

[57] ABSTRACT

A hand tool for spreading plaster on a substrate such as a ceiling and the like in decorative designs in a repeating pattern having a stiff but resilient blade with a serrated distal, longitudinal edge. A handle is attached to the resilient blade at an opposite or proximal edge of the resilient blade from the serrated distal edge of the resilient blade. In one embodiment, the resilient blade includes two spaced-apart tool alignment marks for aligning the tool with a previously-made design of the pattern to align the next repeated design therewith. In another embodiment, the hand tool includes a pivot device associated with the resilient blade proximate one end of the resilient blade to define a location on the substrate about which the tool is to be moved to generate the design.

15 Claims, 3 Drawing Sheets

HAND TOOL FOR DECORATIVELY APPLYING PLASTER

BACKGROUND OF THE INVENTION

The present invention relates to plaster spreading devices and more specifically to serrated hand tools for spreading plaster and the like in decorative patterns.

U.S. Pat. No. 2,287,231, issued on Jun. 23, 1942 to M. M. Cathcard, is directed to a paste spreader for spreading paste, cement, glue and the like on a surface to be covered with a covering such as linoleum which evenly distributes the paste. The spreader blade is fabricated of a flexible material and is serrated along one edge.

U.S. Pat. No. 2,824,330, issued on Feb. 25, 1958 to L. Williams, is directed to a spreader for cement and the like on a surface to be covered with a covering, such as formica, which evenly spreads the cement. The spreader blade is square and is removably attached to a handle. Each of the four edges of the blade has different sized notches or serrations.

U.S. Pat. No. 3,916,472, issued on Nov. 4, 1975 to William Carder, is directed to a trowel for applying adhesives to a surface such as a floor or wall to be covered. The edges of the trowel are serrated to evenly spread the adhesive.

U.S. Pat. No. 4,654,919, issued on Apr. 7, 1987 to I. Lieberman, is directed to a spreader for applying plaster and cement to wallboard. The spreader has a spreader blade attached to a handle with a backing layer next to the blade to add rigidity to the blade. The edge of the blade extends past the edge of the backing layer. The plate is made of a flexible material such as plastic and has a straight edge as opposed to a serrated edge.

The above-mentioned patents disclose spreader tools representative of the prior-art tools known to me, and have drawbacks which render them inadequate or unsuitable for making accurate uniform decorative patterns of a repeating design.

SUMMARY OF THE INVENTION

The present invention recognizes the drawbacks of the prior art tools and provides a solution which provides for the formation of accurate decorative designs in a uniformly repeated pattern in plaster and the like on a substrate such as a wall or ceiling.

In one embodiment, the present invention provides a hand tool for spreading plaster and the like on a substrate in accurate design of a uniformly repeating pattern, the tool having a resilient blade with a serrated distal, longitudinal edge and a handle mounted to the other or proximal edge of the resilient blade. Tool locating and alignment marks are formed on the blade at preselected intervals along the length of the blade proximate the distal, longitudinal edge for aligning the tool with a previously-formed design preparatory to forming a subsequent substantially identical design adjacent the previously-formed design.

In another embodiment, the present invention provides a hand tool for spreading plaster and the like on a substrate in accurate designs of a uniformly repeating pattern, the tool having a resilient blade with a serrated distal, longitudinal edge and a handle mounted to the other or proximal edge of the resilient blade. The tool further includes a pivot device associated with the blade proximate one end of the blade to define a location on the substrate about which the tool is to be moved to locate the tool relative to a starting location and previously formed designs, and about which the tool is to be moved to generate the design.

BRIEF DESCRIPTION OF THE DRAWINGS

The various objectives and features of the present invention will become even more clear upon reference to the following discussion in conjunction with the accompanying drawings, wherein like numerals refer to like parts through the several figures in which.

DETAILED DESCRIPTION OF THE EMBODIMENT

Figure 1:
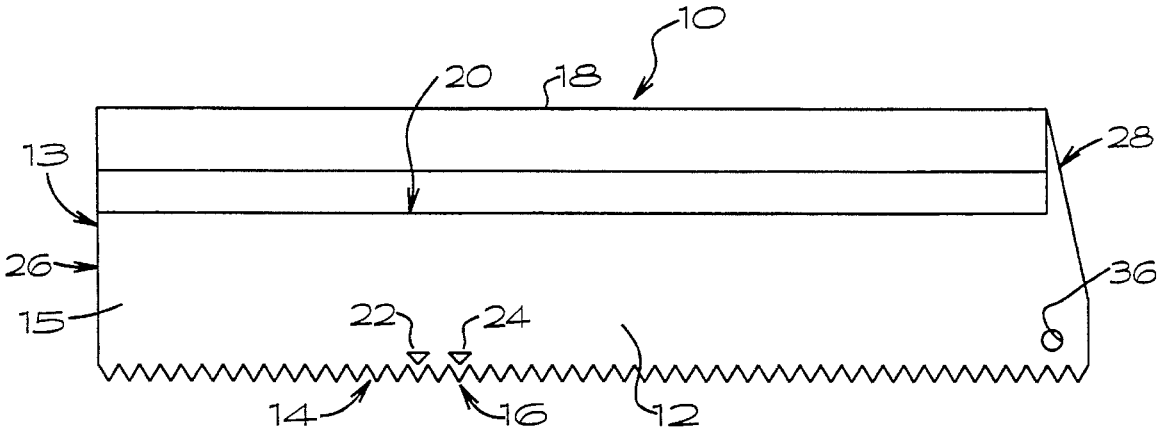
FIG. 1 is a side view of one embodiment of a tool of the present invention for forming accurate designs in a uniformly repeating pattern in plaster and the like on a substrate.

With reference to FIGS. 1 through 9, there is shown a hand tool, generally denoted as the numeral 10, for spreading plaster and the like in accurate designs in a uniformly repeating pattern.

The tool 10 has a stiff, yet resilient, blade 12 having two side surfaces 13 and 15 with serrations 14 formed along distal longitudinal edge 16 of the blade 12. A handle 18 is mounted to the blade 12 at the blade proximal longitudinal edge 20. As shown, the handle 18 is attached to and extends along the length of the proximal edge of the blade 12.

Figure 2:
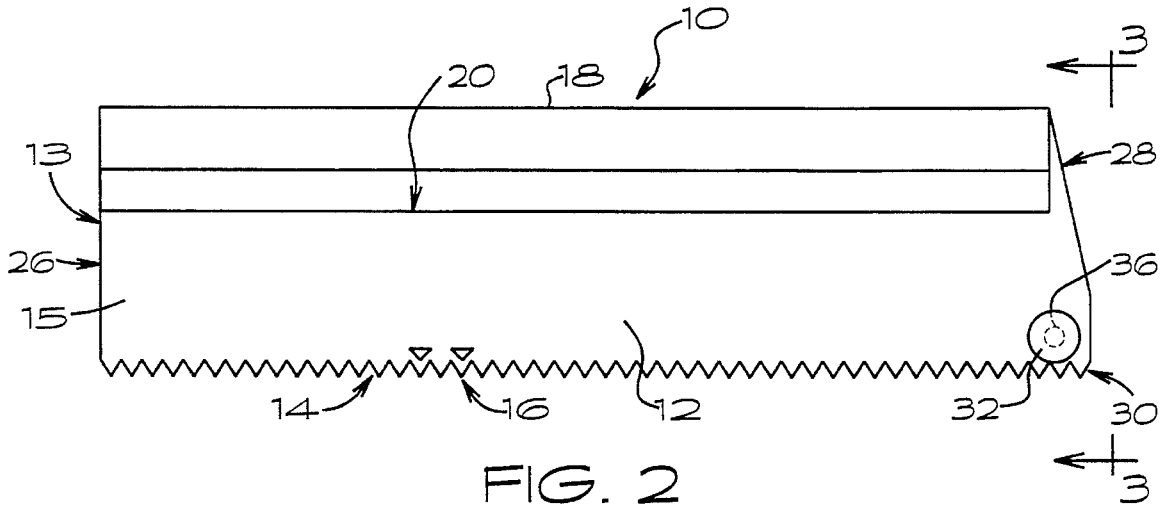
FIG. 2 is a side view of another embodiment of the tool of the present invention.

With reference to FIGS. 1 and 2, the tool 10 includes tool alignment and locating indicia or marks 22 and 24 on blade 12 proximate the distal, longitudinal edge 16 adjacent the serrations 14. The marks 22 and 24 are located more closely to one end 26 of the blade 12 than to the other end 28 of the blade 12. The first mark 22 is located about one-third of the length of the blade from the one end 26 and the second mark 24 is located about one-twelfth of the length of the blade from the first mark 22. A mark 22 or 24 can be positioned in alignment with a previously-made design to properly locate the serrations 14 of the tool blade for forming the next repeated design of the pattern.

With reference to FIGS. 2–9, in further embodiments, the hand tool, generally denoted as the numeral 10, comprises pivot means, generally denoted as the numeral 30, associated with the blade 12. The pivot means 30 is used to locate the tool relative to a starting position of a previously formed design, and for guiding the tool 10 in an arcuate path with the serrations 14 in contact with the plaster on the substrate.

Figure 3:
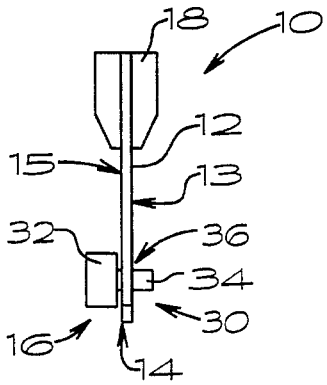
FIG. 3 is a cross-sectional end view of the tool of FIG. 2 as seen in the direction of arrows 3—3 in FIG. 2.

FIGS. 2 and 3 illustrate the tool 10 wherein the pivot means 30 comprises a hand grasp knob 32 having a pin 34 attached thereto, and a pin-receiving aperture 36 formed through the blade 12 proximate the blade end 28 above the distal blade edge 16. The pin 34 is received through the aperture 36 to project from one side surface 13 of the blade 12 with the knob 32 adjacent the other side surface 15 of the blade 12. It should be noted that the pin 34 is removably received in the aperture 36 so that the pivot means 30 can be removed from the blade 12.

In use of the tool 10, a coating of layer of plaster or the like is spread smoothly on the substrate with a conventional trowel or roller. The tool 10 is located with the serrations 14 on the distal blade edge 16 against the coated substrate and with the projecting end of the pivot pin 34 positioned at a predetermined point on the coated substrate which predetermined point defines the center of the arcuate design to be formed on the coating of the substrate. The user then moves the tool 10 in a arcuate path around the pivot pin 34 so that the serrations 14 create a plurality of equally spaced-apart concentric arcuate lines in the coating.

Figure 4:
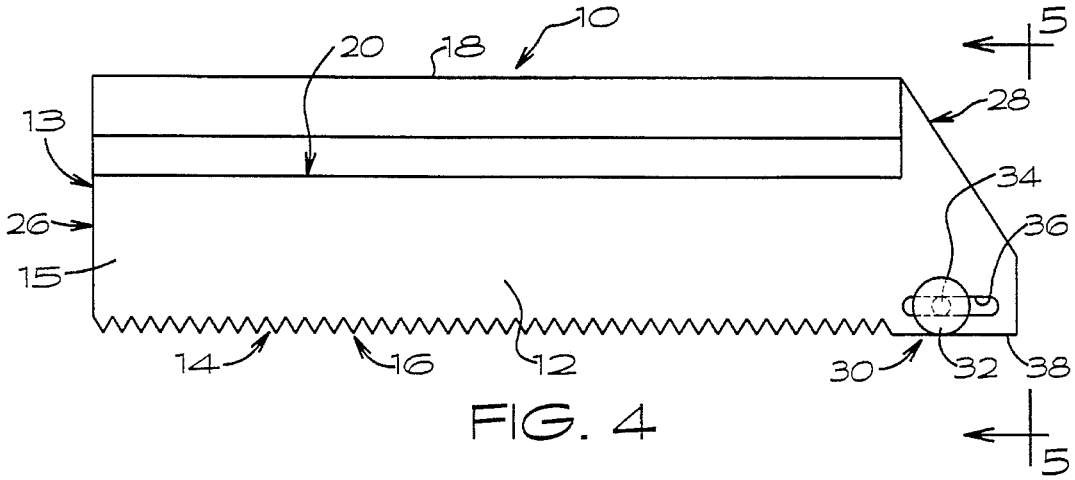
FIG. 4 is a side view of yet another embodiment of the tool of the present invention.
Figure 5:
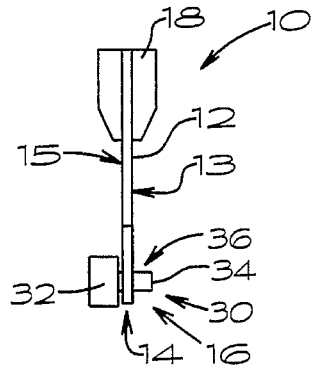
FIG. 5 is an end view of the tool of FIG. 4 as seen in the direction of arrows 5—5 in FIG. 4.

FIGS. 4 and 5 illustrate the tool 10, wherein the pivot means 30 comprises a hand grasp knob 32 having the pin 34 attached thereto, and an elongated pin-receiving slot 36 formed through the blade 12 proximate the blade end 28. As shown best in FIG. 4, the blade 12 is formed with a longitudinal extension 38 longitudinally extending outwardly from the blade end 28. The elongated pin-receiving slot 36 has its major axis parallel to the distal, longitudinal edge 16 of the blade 12. The pin 34 is received through the elongated pin-receiving slot 36 to project from one side surface 13 of the blade 12 with the knob 32 adjacent the other side surface 15 of the blade 12. The pin 34 is slidable along the major axis of the elongated slot 36.

In use of the tool 10, the tool 10 is located with the serrations 14 on the distal blade edge 16 against the coated substrate and with the projecting end of the pivot pin 34 positioned at a predetermined point on the coated substrate which predetermined point defines the center of an arcuate design to be formed in the coating on the substrate. That is, in contrast to tools where the blade and substrate are at approximately right angles, with the pivot pin 34 at approximately a right angle with the coated substrate, the blade 12 and the coated substrate have a smaller acute angle therebetween, for example, forty-five degrees or less. The user then has two choices as to how to move the tool 10. The user can move the tool 10 in a constant radius arcuate path around the pivot pin 34 so that the serrations 14 create concentric arcuate lines in the coating. Alternatively, the user can simultaneously move the tool 10 in an arcuate path around the pivot pin 34 and oscillate the blade 12 back and forth longitudinally of the blade 12 along the major axis of the elongated slot 36 varying the radius of the arcuate path around the pivot pin 34 so that the serrations 14 create a wavy arcuate design in the coating on the substrate.

Figure 6:
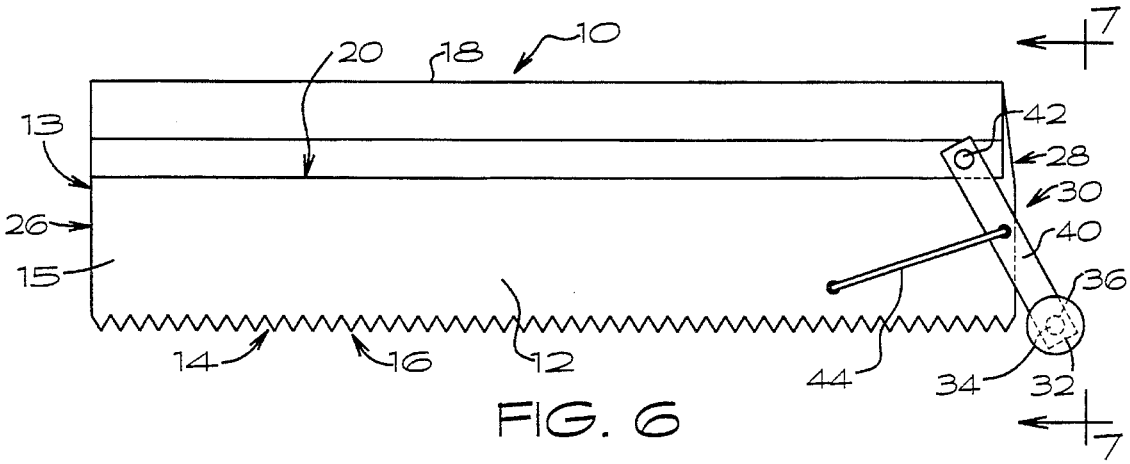
FIG. 6 is a side view of still another embodiment of the tool of the present invention.
Figure 7:
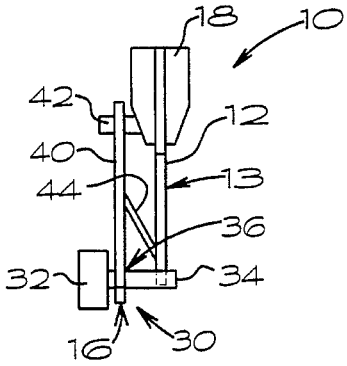
FIG. 7 is an end view of the tool of FIG. 6 as seen in the direction of arrows 7—7 in FIG. 6.

FIGS. 6 and 7 illustrate the tool 10 wherein the pivot means 30 comprises a radius arm 40 attached at a proximal end to the blade 12 by a pivot 42 at one side 15 of the blade 12 which defines a first fulcrum point. The pivot means 30 also includes a hand-grasp knob 32 having a pin 34 attached thereto and a pin-receiving aperture 36 formed through the radius arm 40 proximate the distal end of the radius arm 40. The pin 34 is received through the aperture 36 to project from one side of the radius arm 40 with the knob 32 adjacent the other side of the radius arm 40. The pin 34 defines a second fulcrum point. The pivot means 30 further comprises resilient means 44 interconnecting the radius arm 40 and the blade 12 for generating a force resisting rotation of the radius arm 40 about the first fulcrum point of pivot 42. The biasing means 42 can be of virtually any convenient design or resilient material such as a compression coil spring attached at one end of the blade 12 and attached at the other end to the radius arm 40, or as shown in FIG. 6, a rubber band attached at one end of the blade 12 and attached at the other end to the radius arm 40.

In use of the tool 10, the tool 10 is located with the serrations 14 on the distal edge 16 against the coated substrate and with the projecting end of the pivot pin 34 positioned at a predetermined point on the coated substrate which predetermined point defines the center of an arcuate design to be formed in the coating on the substrate. The user then has two choices as to how to move the tool 10. The user can move the tool 10 in a constant radius arcuate path around the pivot pin 34, maintaining a constant tension on the biasing means 44, so the serrations 14 create concentric arcuate lines in the coating. Alternatively, the user can simultaneously move the tool 10 in an arcuate path and oscillate the blade 12 back and forth longitudinally of the blade 12 against the biasing force of the biasing means 44. As the blade 12 is longitudinally oscillated, the radius arm 40 pivots about the first fulcrum or pivot 42 while the pin 36 remains in position on the predetermined center of the design varying the radius of the arcuate path around the pin 34 so the serrations 14 create a wavy arcuate design in the coating on the substrate. The biasing means 44, by providing a resistance force to the oscillating movement of the blade 12, provides for additional control over the oscillating movement of the blade 12.

Figure 8:
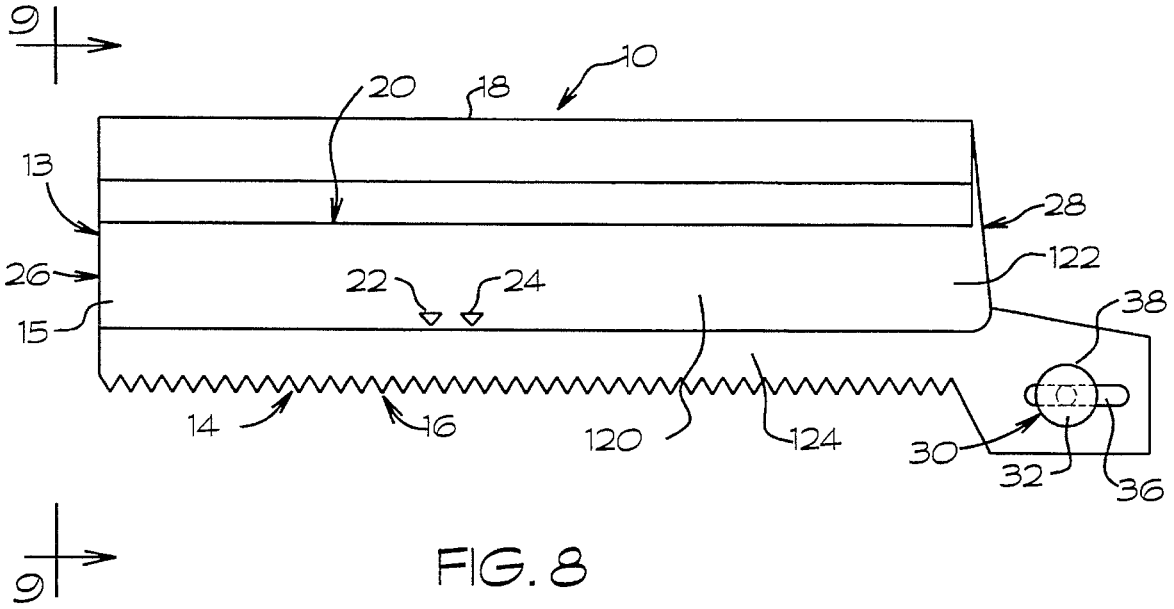
FIG. 8 is a side view of yet another embodiment of the tool of the present invention; and, FIG. 9 is an end view of the tool of FIG. 8 as seen in the direction of arrows 9—9 in FIG. 8.
Figure 9:
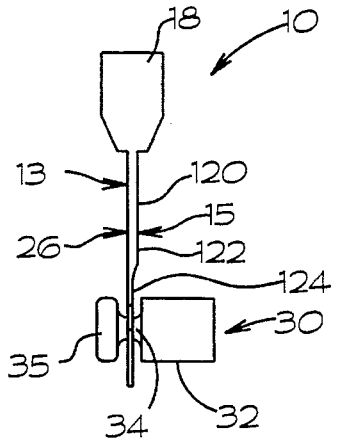

FIGS. 8 and 9 illustrate a tool 10, which I now believe is the best mode to practice my invention. The tool 10 is of unitary construction, except for pivot means 30, which is also of unitary construction. Tool 10 and pivot means 30 are, for example, made by injection molding. Tool 10 is shown having a blade 120. Blade 120 is like the other embodiments in that it has side surfaces 13 and 15 and ends 26 and 28. As with the other embodiments, side 13 is planar. However, side 15 is not planar. Side 15 has a thicker portion 122 and a thinner portion 124, thinner portion 124 having the serrations 14 therein. As with all embodiments, to use the tool 10, the blade 120 is positioned to be at an acute angle with the coated substrate. With tool 10, (side 13 is placed toward the substrate coatings) and thinner portion 124 permits the serrations 14 to be more flexible than in the other embodiments so that serrations 14 do not pull the coating off of the substrate. If blade 120 was all the thickness of thinner portion 124, blade 120 would bend too easily and not form a uniform pattern in the substrate coating. For example, it is preferred that the thinner portion 124 have a thickness of about 0.5 mm or 0.020 inch and that the thinner portion extend from the tips of serrations 14 toward the handle 18 a distance of about 19 mm or 0.75 inch. As shown, thicker portion extends about 85 mm or 3.3 inches between thinner portion 124 and handle 18 and has a thickness of about 2 mm or 0.08 inch. Alignment marks 22, 24, previously described, are shown at the serration edge of thicker portion 122.

Pivot means 30 comprises a hand grasp knob 32 and a pin head 35 having a pin 34 attached therebetween, pivot means 30 being of preferably unitary construction. Blade 120 has an extension 38 longitudinally extending outwardly from the blade end 28. Extension 38 has an elongated pin-receiving slot 36 having a major axis parallel to the distal, longitudinal edge 16 of the blade 12. More particularly, the major axis of the elongated pin-receiving slot 36 is in alignment with the points or tips of the serrations 14. Extension 38 having elongated pin-receiving slot 36 is flexible enough that pivot means 30 is insertable into or removable from slot 36. As shown best in FIG. 9, the pin 34 between head 35 and knob 32 is received through the elongated pin-receiving slot 36. Head 35 project from side surface 13 of the blade 120 and knob 32 projects from the other side surface 15. Head 35 is the pivot button which touches the substrate coating and is preferably rounded. Knob 32 is preferably about 25 mm or 1 inch long. The pin 34 is slidable along the major axis of the elongated slot 36. As previously described, the tool 10 of FIGS. 8 and 9 can be used to create arcuate designs or wavy arcuate designs.

The foregoing detailed description is given primarily for clearness of understanding of the present invention and no unnecessary limitations are to be understood thereby for modifications will become obvious to those skilled in the art upon reading this disclosure and may be made without departing from the spirit of the invention or scope of the appended claims.

What is claimed is:

1. A hand tool for creating arcuate designs in plaster and the like coating a substrate comprising:

a blade having a serrated longitudinal distal edge for creating decorative lines in the plaster;

a handle attached to the blade; and, means defining tool alignment and locating indicia on the blade at predetermined intervals along the length of the blade.

2. The hand tool of claim 1, wherein the indicia comprise:

a first mark located about one-third of the length of the blade from one end of the blade; and, a second mark located about one-twelfth of the length of the blade from the first mark.

3. A hand tool for creating arcuate designs in plaster and the like coating a substrate comprising:

a blade having a serrated longitudinal distal edge for creating decorative lines in the plaster;

a handle attached to the blade; and pivot means structurally associated with the blade proximate one end of the blade for locating the blade relative to a predetermined location on the coated substrate and defining a location about which the blade is to be moved, said pivot means being proximate one end of the tool.

4. The hand tool of claim 3, wherein the pivot means comprises a pin attached to the blade projecting outwardly from one side surface of the blade.

5. The hand tool of claim 4, wherein the pin is located proximate the serrated longitudinal distal edge of the blade.

6. The hand tool of claim 3, wherein the pivot means comprises:

a hand-grasp knob located at one side surface of the blade; and a pivot pin opposite the hand-grasp knob and projecting outwardly from the other side surface of the blade.

7. The hand tool of claim 6, wherein the pivot means comprises:

the pivot pin being attached to the hand-grasp knob;

a pivot pin-receiving aperture formed through the blade; and, the pivot pin being removably received through the aperture to project from one side surface of the blade with the hand-grasp knob located adjacent the other side surface of the blade.

8. The hand tool of claim 3, wherein the pivot means comprises:

a pivot pin; and, an elongated pin-receiving slot formed through the blade having its major axis generally in-line with the serrated longitudinal distal blade edge for receiving the pin therethrough for slidable movement therealong.

9. The hand tool of claim 8, wherein the pivot means comprises:

a longitudinal extension longitudinally extending outwardly from one end of the blade; and the elongated pin-receiving slot is formed in the extension.

10. The hand tool of claim 8, wherein the major axis of the elongated pin-receiving slot is in general alignment with the serrations formed in the longitudinal distal edge of the blade.

11. The hand tool of claim 8, further comprising:

a hand-grasp knob;

the pin being attached to the knob such that with the pin received through the elongated slot, the pin projects from one side surface of the blade and the handle is adjacent the other side surface of the blade.

12. The hand tool of claim 3, wherein the pivot means comprises:

a radius arm;

means pivotally attaching the radius arm at a proximal end of the radius arm to the blade;

a pivot pin attached to the radius arm at a distal end of the radius arm and projecting outwardly from one side thereof; and biasing means interconnecting the radius arm and the blade.

13. The hand tool of claim 12, further comprising a hand-grasp knob located adjacent the distal end of the radius arm to the opposite side of the radius arm from the pivot pin.

14. The hand tool of claim 13, wherein:

the hand-grasp knob is attached to the pivot pin; and the radius arm is formed with a pin-receiving aperture near the distal end of the radius arm for receiving the pivot pin so that the pin projects from one side of the radius arm and the hand-grasp knob is located adjacent the other side of the radius arm.

15. The hand tool of claim 3, wherein:

said blade has a thinner portion, said thinner portion including said serrated longitudinal distal edge and a portion adjacent thereto.

* * * * *